US007562398B2

(12) United States Patent
Béland et al.

(10) Patent No.: US 7,562,398 B2
(45) Date of Patent: Jul. 21, 2009

(54) HOCKEY GLOVE

(75) Inventors: Jean-François Béland, Montreal (CA); Brad James, Dover, NH (US); Jean-François Laperrière, Prévost (CA); Mathieu Contant, Verdun (CA)

(73) Assignee: Bauer Nike Hockey Inc., St. Jerome, Quebec (CA)

( * ) Notice: Subject to any disclaimer, the term of this patent is extended or adjusted under 35 U.S.C. 154(b) by 290 days.

(21) Appl. No.: 11/494,488

(22) Filed: Jul. 28, 2006

(65) Prior Publication Data

US 2008/0034471 A1 Feb. 14, 2008

(51) Int. Cl.
*A41D 19/00* (2006.01)

(52) U.S. Cl. ..... 2/161.1

(58) Field of Classification Search ..... 2/16, 2/20, 161.1, 161.6
See application file for complete search history.

(56) References Cited

U.S. PATENT DOCUMENTS 3,626,515 A * 12/1971 Murray ..... 2/16
5,168,578 A * 12/1992 Stanley ..... 2/19
5,511,242 A * 4/1996 Bianchi ..... 2/16
5,987,642 A * 11/1999 Webster ..... 2/19
6,427,249 B1 * 8/2002 Mattesky ..... 2/161.6

* cited by examiner

*Primary Examiner*—Katherine Moran

(57) ABSTRACT

A hockey glove for receiving a hand of a player, the hand having a palm, index finger, middle finger, third finger and little finger, each finger having inner, dorsal, lateral and medial surfaces, proximate, middle and distal phalanges, one thumb with palm and dorsal surfaces, and a medial side with a C-shaped edge between the thumb and the index finger, the hockey glove comprising: (a) a side finger web for facing the lateral and medial surfaces of each finger, the side finger web having a lower web periphery; (b) a palm sheet for facing the palm of the hand and the palm surface of the fingers and thumb, the palm sheet having a palm periphery with a portion connected to the lower web periphery for defining first, second, third and fourth finger gussets for respectively receiving the four fingers; (c) a side pad for covering at least partially the medial side of the hand, the side pad having a top portion and a side portion with an edge for overlapping the C-shaped edge of the medial side of the hand; and (d) a layer covering at least partially the palm sheet, the layer comprising a portion extending over the side portion of the side pad.

29 Claims, 10 Drawing Sheets

HOCKEY GLOVE

FIELD OF THE INVENTION

The present invention relates to hockey gloves.

BACKGROUND OF THE INVENTION

A traditional hockey glove for receiving a hand of a player has a hand receiving portion covering the palm and dorsal side of the hand and extending generally to the end of the fingers and a thumb sheath enclosing the thumb. The hand receiving portion comprises four finger sheaths for enclosing the index finger, middle finger, third finger and little finger and a palm sheet for facing the palm of the hand and the palm surface of the fingers and thumb.

The traditional hockey glove further comprises a band of material (braiding) surrounding the periphery of the thumb sheath, extending along a portion between the thumb sheath and the index finger sheath and further along the side of the index finger sheath. This band of material is used to affix the periphery of the palm sheet to the thumb sheath, to the portion between the thumb sheath and the index finger sheath and to the side of the index finger sheath.

As it is well known, in use, for a player who is a right shooter, his right hand moves along the hockey stick, and the presence of the aforesaid band of material may impede the movement of the hand along the hockey stick. There is therefore a need in the industry to provide a hockey glove that increases freedom of movement along the hockey stick.

SUMMARY OF THE INVENTION

As embodied and broadly described herein, the present invention provides a hockey glove for receiving a hand of a player, the hand having a palm, index finger, middle finger, third finger and little finger, each finger having inner, dorsal, lateral and medial surfaces, proximate, middle and distal phalanges, one thumb with palm and dorsal surfaces, and a medial side with a C-shaped edge between the thumb and the index finger, the hockey glove comprising: (a) a side finger web for facing the lateral and medial surfaces of each finger, the side finger web having a lower web periphery; (b) a palm sheet for facing the palm of the hand and the palm surface of the fingers and thumb, the palm sheet having a palm periphery with a portion connected to the lower web periphery for defining first, second, third and fourth finger gussets for respectively receiving the four fingers; (c) a side pad for covering at least partially the medial side of the hand, the side pad having a top portion and a side portion with an edge for overlapping the C-shaped edge of the medial side of the hand; and (d) a layer covering at least partially the palm sheet, the layer comprising a portion extending over the side portion of the side pad.

The invention further provides a hockey glove for receiving a hand of a player, the hand having a palm, index finger, middle finger, third finger and little finger, each finger having inner, dorsal, lateral and medial surfaces, proximate, middle and distal phalanges, one thumb with palm and dorsal surfaces, and a medial side with a C-shaped edge between the thumb and the index finger, the hockey glove comprising: (a) a side finger web for facing the lateral and medial surfaces of each finger, the side finger web having a lower web periphery; (b) a side pad for covering at least partially the medial side of the hand, the side pad having a top portion and a side portion with an edge for overlapping the C-shaped edge of the medial side of the hand; (c) a thumb sheath for enclosing the thumb, the thumb sheath having a thumb sheath periphery; (d) a palm sheet for facing the palm of the hand and the palm surface of the fingers and thumb, the palm sheet having a palm periphery, the palm periphery having a first palm periphery portion connected the thumb sheath periphery via a braiding, a second palm periphery portion connected to the lower web periphery for defining first, second, third and fourth finger gussets for respectively receiving the four fingers, and a third palm periphery portion connected to the edge of the side portion of the side pad; and (e) a layer for covering at least partially the palm sheet, the layer comprising a portion extending over the third palm periphery portion and the side portion of the side pad.

Other aspects and features of the present invention will become apparent to the persons skilled in the art upon review of the following description of embodiments of the invention in conjunction with the accompanying figures.

BRIEF DESCRIPTION OF THE DRAWINGS

A detailed description of the embodiments of the present invention is provided herein below, by way of example only, with reference to the accompanying drawings, in which.

Figure 1A:
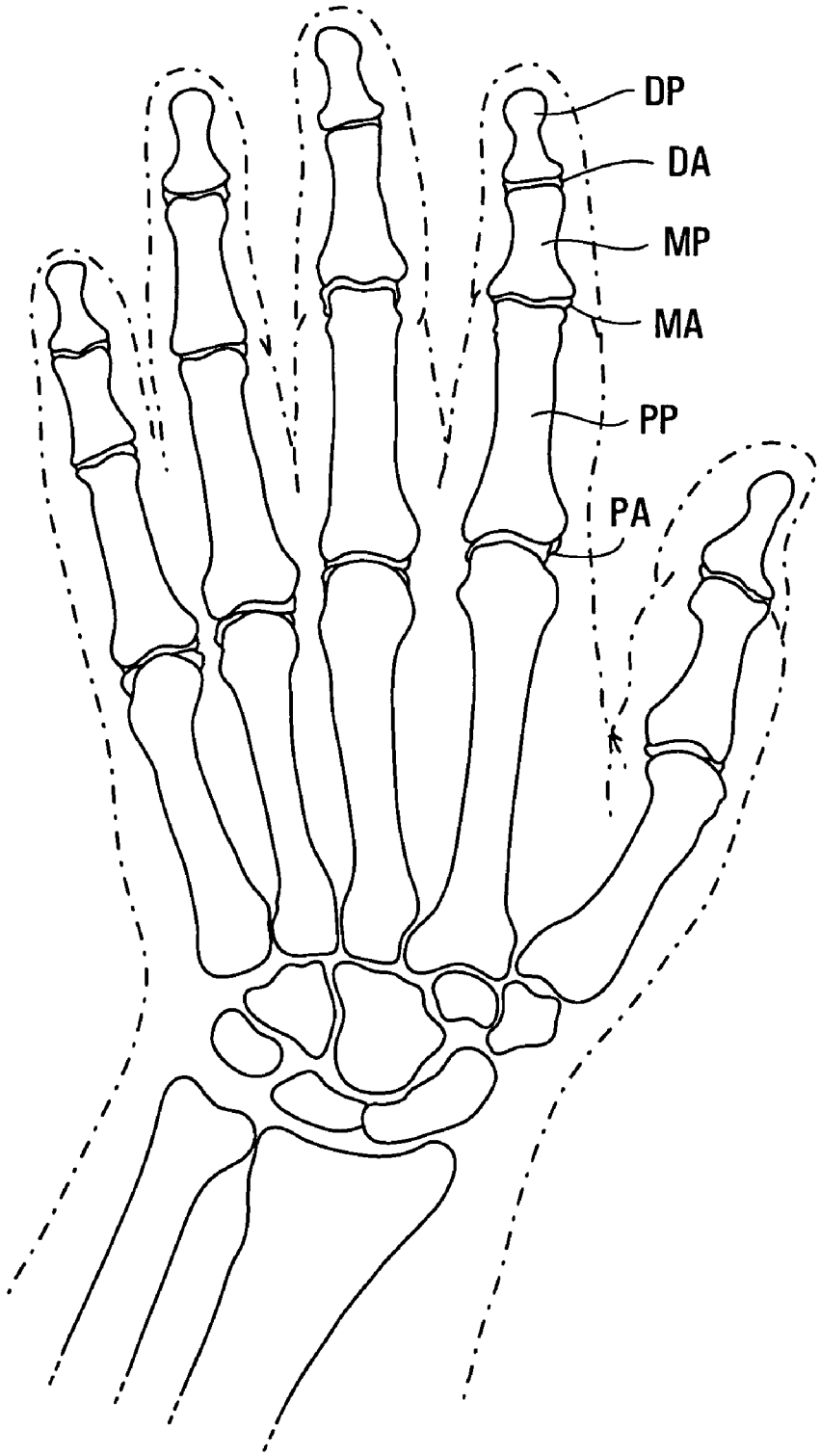
FIG. 1A is a top view of a human hand with the integument of the hand shown in broken lines and the bones shown in full lines.
Figure 1B:
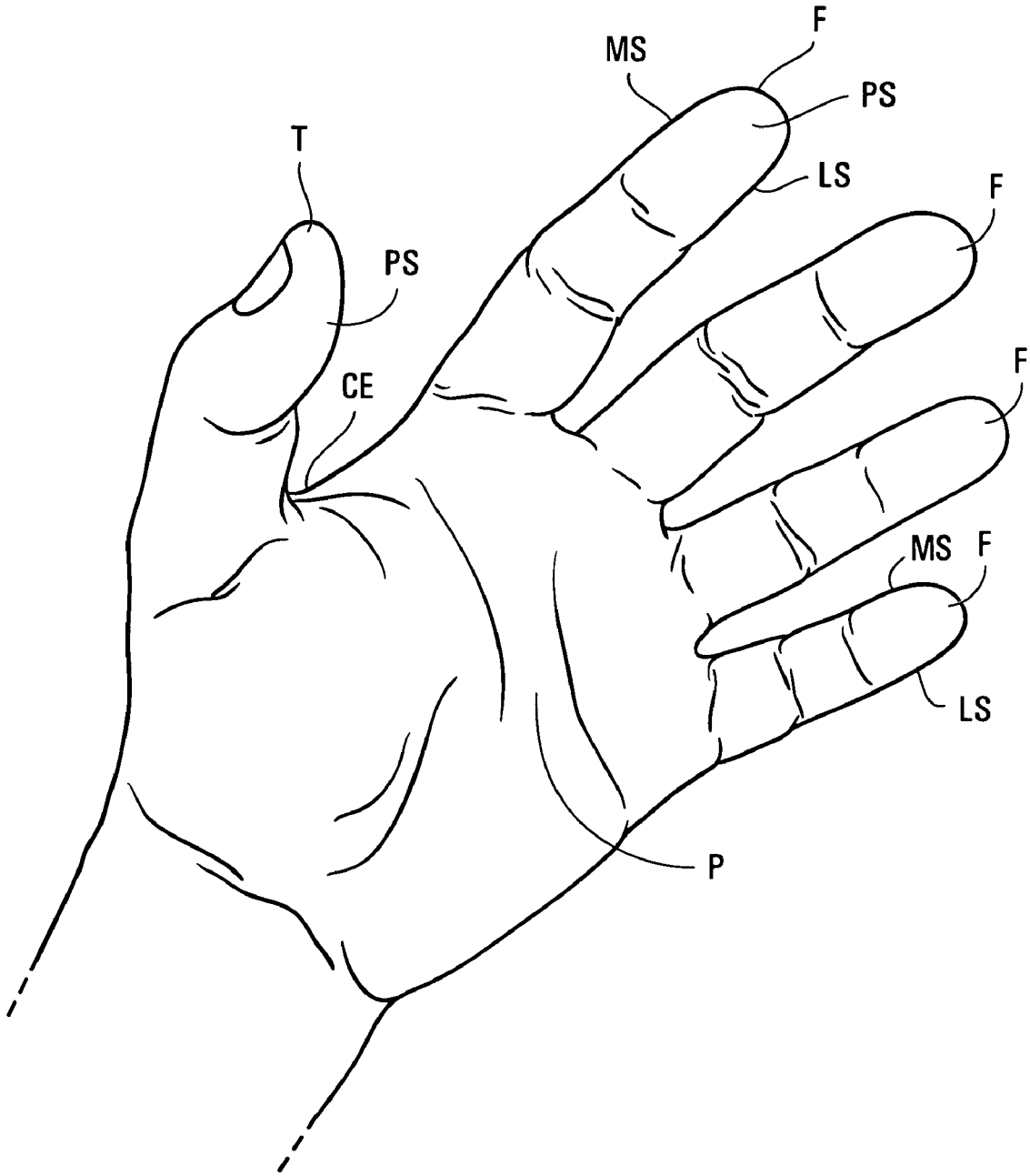
FIG. 1B is a bottom perspective view of a human hand.
Figure 1C:
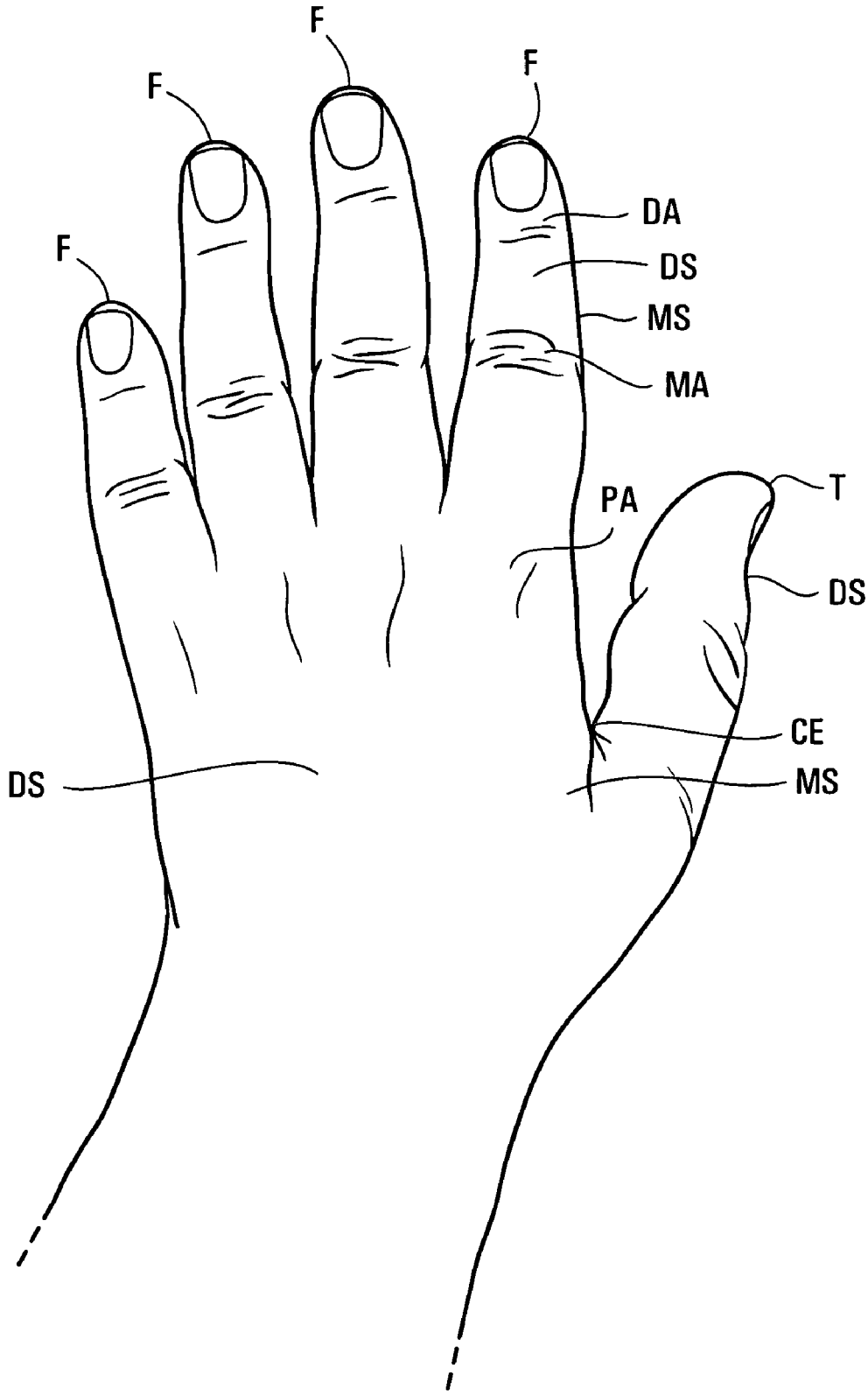
FIG. 1C is a top perspective view of the human hand of FIG. 1B.
Figure 1D:
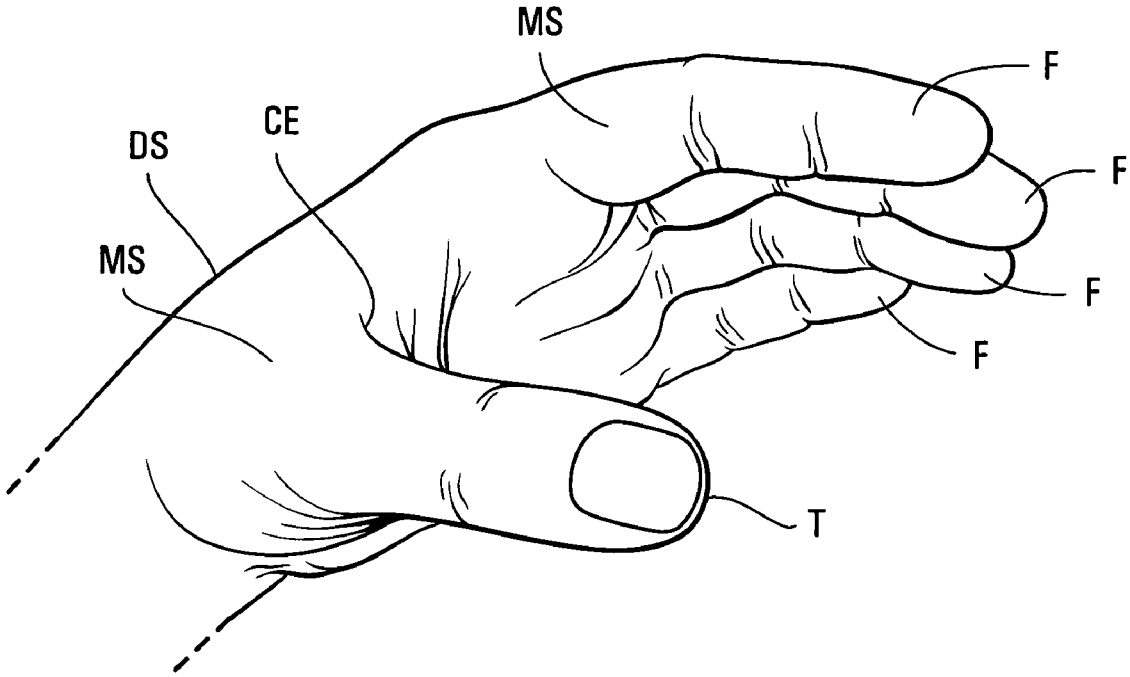
FIG. 1D is a side perspective view of the human hand of FIG. 1B

In the drawings, the embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE EMBODIMENTS

To facilitate the description, any reference numerals designating an element in one figure will designate the same element if used in any other figures. In describing the embodiments, specific terminology is resorted to for the sake of clarity but the invention is not intended to be limited to the specific terms so selected, and it is understood that each specific term comprises all equivalents.

As shown in FIGS. 1A, 1B, 1C, 1D a human hand comprises a palm P, a dorsal side DS, four fingers F (index finger, middle finger, third finger and little finger), a thumb T and a medial side MS with a C-shaped edge CE extending between the thumb T and the index finger F. Each finger F has a palm surface PS, a dorsal surface DS, a lateral surface LS, a medial surface MS, a proximate articulation PA, a proximate phalanx PP, a middle articulation MA, a middle phalanx MP, a distal articulation DA and a distal phalanx DP. The thumb T has a palm surface PS and a dorsal surface DS.

Figure 2:
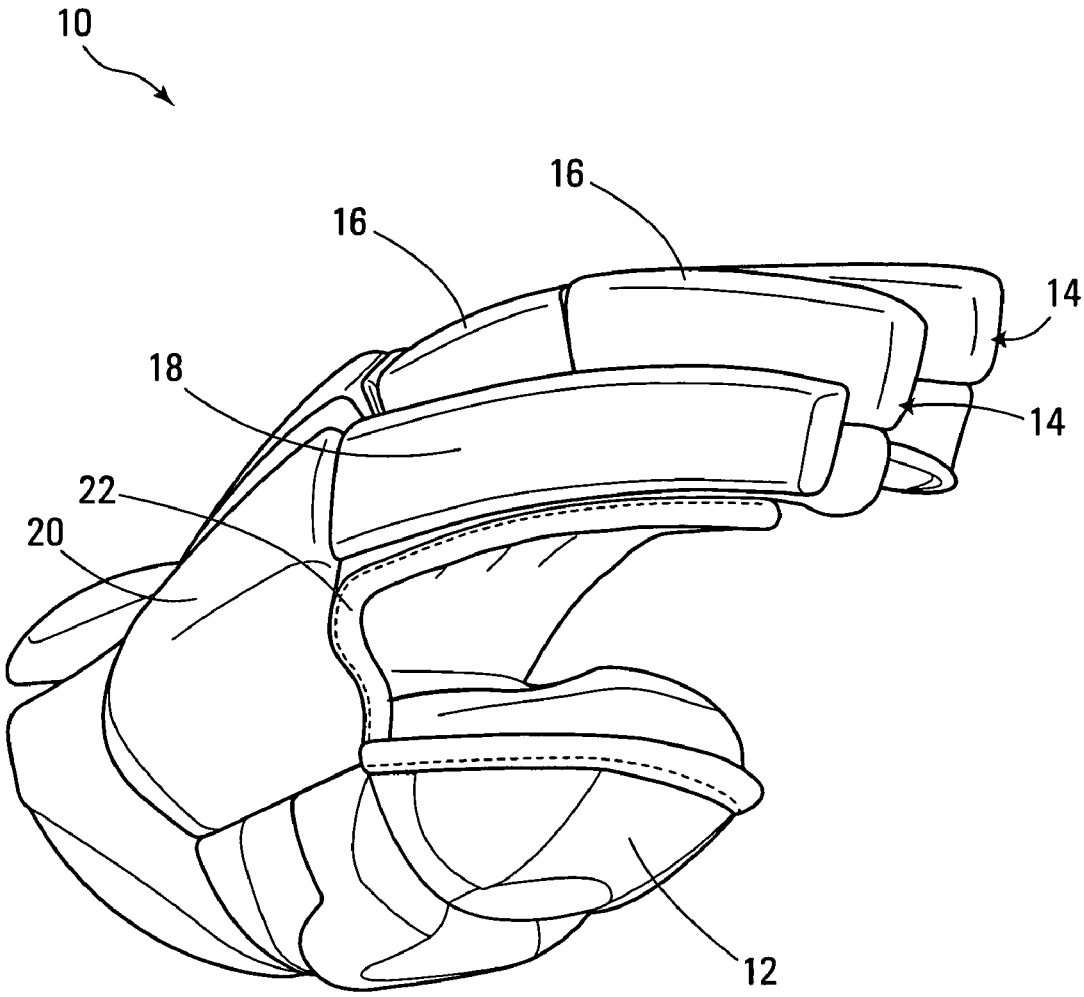
FIG. 2 (Prior Art)
FIG. 2 is a front side perspective view of a prior art hockey glove.
Figure 3:
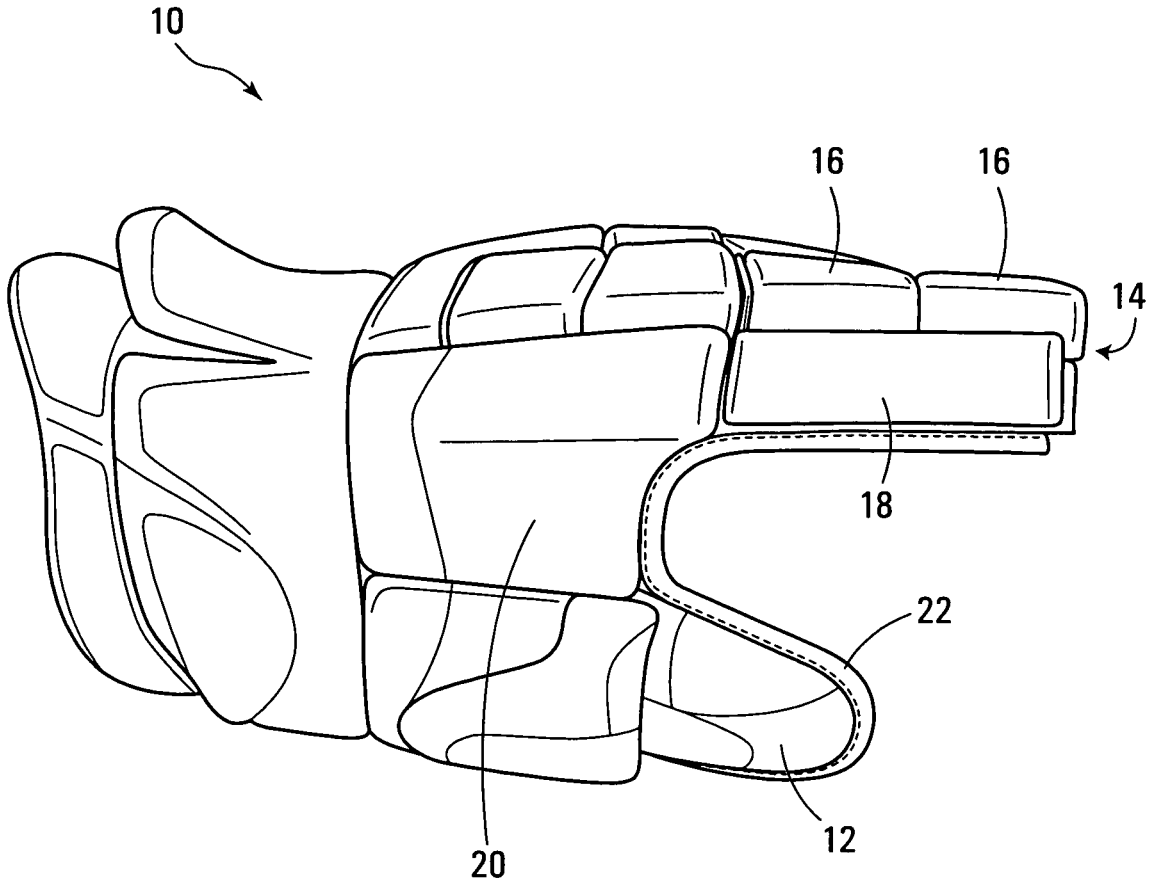
FIG. 3 (Prior Art)
FIG. 3 is a side view of the prior art glove of FIG. 2.

FIGS. 2 and 3 illustrate a prior art hockey glove 10 for receiving the hand of a player. The hockey glove 10 has a hand receiving portion for covering the palm P and dorsal side DS of the hand and extending generally to the end of the fingers F and a thumb sheath 12 for enclosing the thumb T. The hand receiving portion comprises four finger sheaths 14 for enclosing the index finger, middle finger, third finger and little finger, a palm sheet for facing the palm P and the palm surfaces PS of the respective fingers F and the palm surface PS of the thumb T and a dorsal sheet for covering the dorsal surface DS of the respective fingers F. The hand receiving portion also comprises a side finger web for facing the lateral surface LS and medial surface MS of each finger F, this side finger web being connected to the palm and dorsal sheets for defining finger gussets for enclosing the fingers F.

The hockey glove 10 further comprises finger pads 16 for protecting the dorsal surface DS of each finger F, a side index finger pad 18 for protecting the medial side of the index finger F and a side pad 20 for protecting the medial side MS of the hand.

The hockey glove 10 also comprises a braiding 22 surrounding the periphery of the thumb sheath 12, extending along a portion between the thumb sheath 12 and the index finger sheath 14 and further along the side of the index finger sheath 14, just below the index finger pad 18. The braiding 22 is used to affix a portion of the periphery of the palm sheet to the thumb sheath 12, to the portion between the thumb sheath 12 and the index finger sheath 14 and to the side of the index finger sheath 14.

Hence, in the prior art glove 10, because of the presence of the braiding 22 in the region between the thumb sheath 12 and the index finger sheath 14, the movement of the hand of the player along a hockey stick may be impeded and there is therefore a need to eliminate the braiding in this region.

Figure 4:
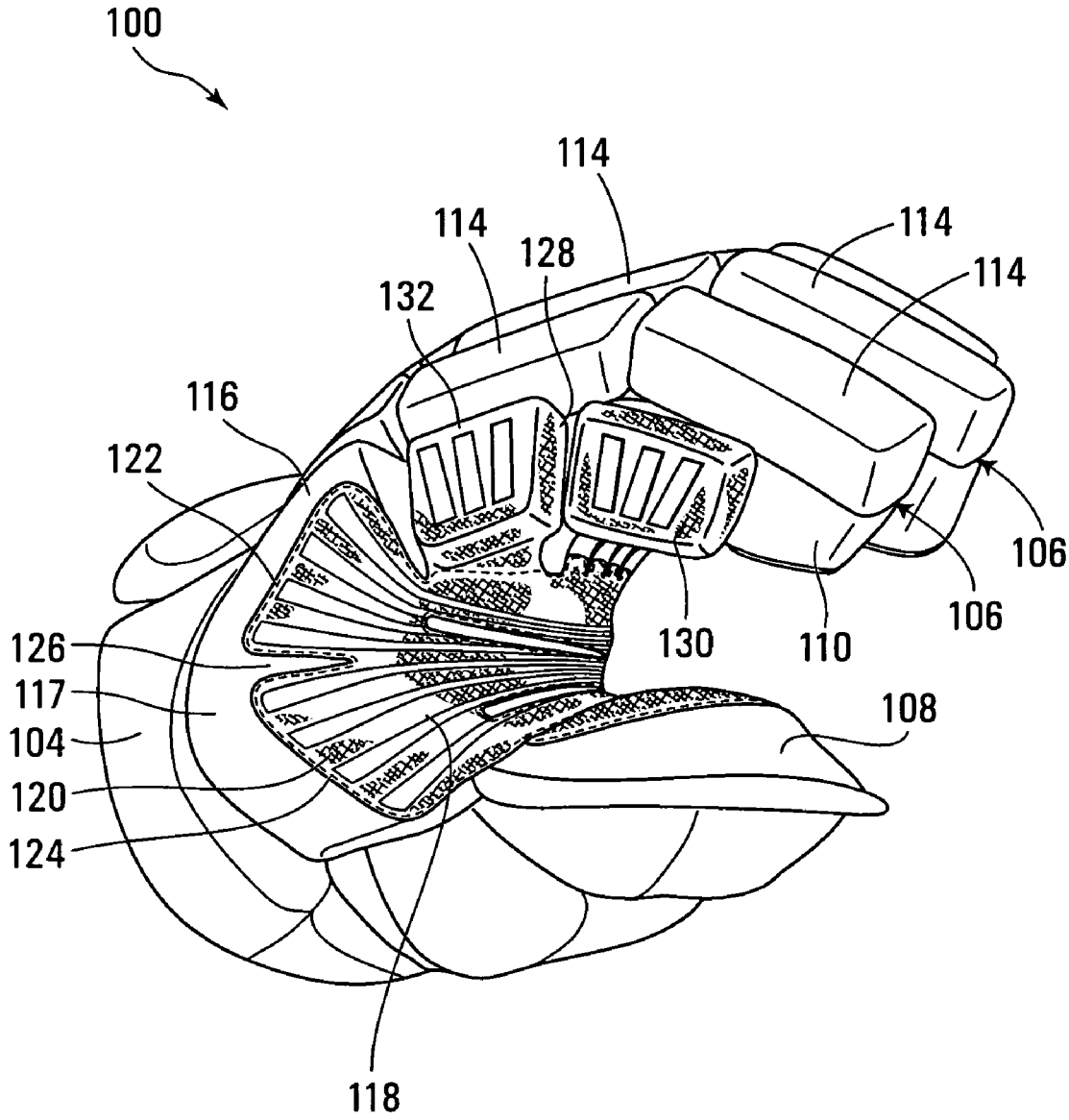
FIG. 4 is a front side perspective view of a hockey glove constructed in accordance with the invention.
Figure 5:
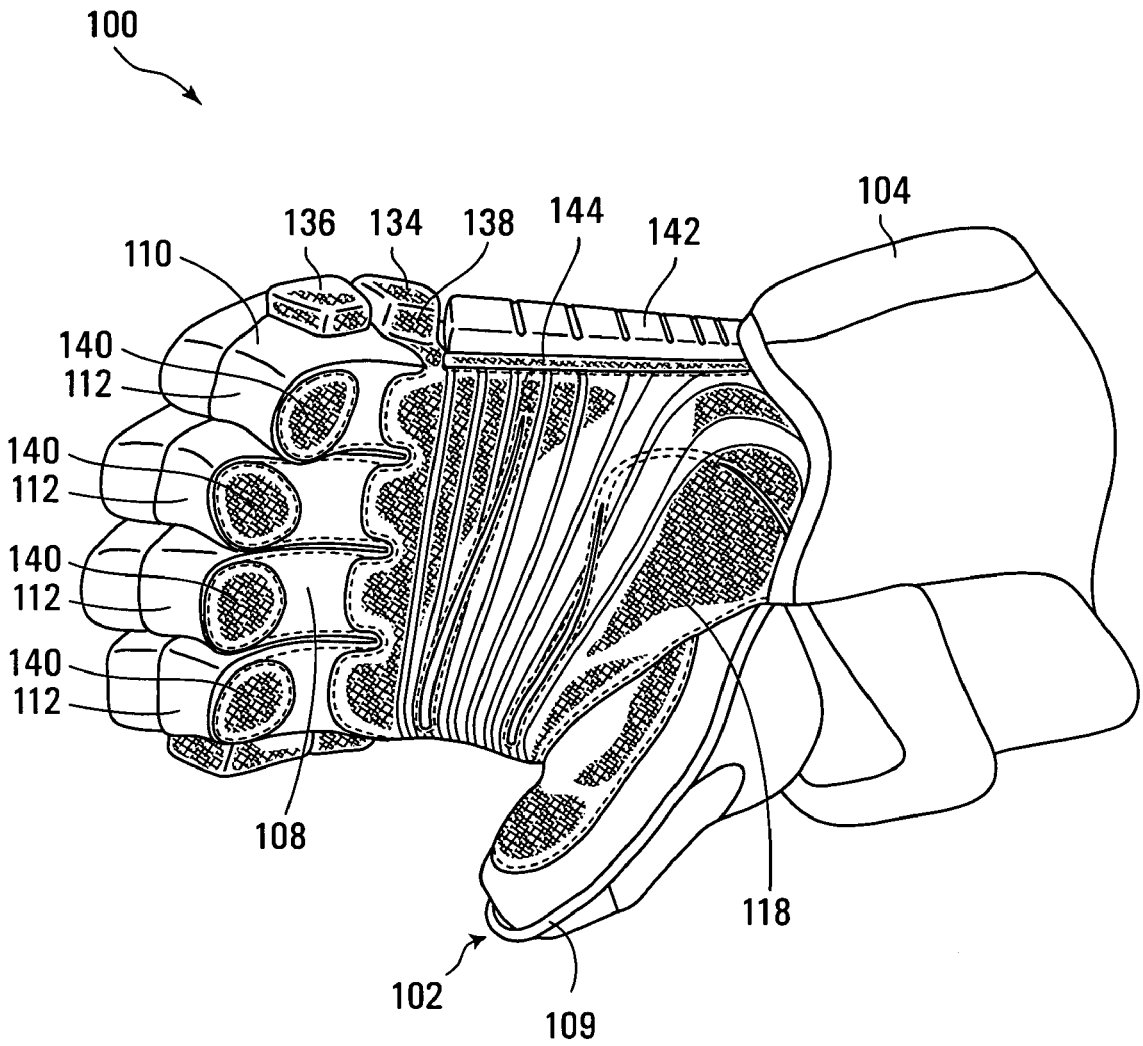
FIG. 5 is bottom perspective view of the hockey glove of FIG. 4.

FIGS. 4 and 5 illustrate a hockey glove 100 constructed in accordance with an embodiment of the invention. The hockey glove 100 has a hand receiving portion for covering the palm P and dorsal side DS of the hand and extending generally to the end of the fingers F and a thumb sheath 102 for enclosing the thumb T. The glove 100 further comprises a cuff portion 104, which extends from the wrist up towards the lower forearm of the player, the cuff portion 104 being secured to the hand receiving portion of the glove 100.

The glove 100 comprises four finger sheaths 106 for enclosing the index finger, middle finger, third finger and little finger. The glove 100 also comprises a palm sheet 108 for facing the palm P and the palm surfaces PS of the respective fingers F and the palm surface PS of the thumb T, and a side finger web 110 for facing the lateral surface LS and medial surface MS of each finger F. The side finger web 110 is connected to the palm sheet 108 for defining finger gussets 112 for receiving the fingers F. The palm sheet 108 may be made of a four way stretch NYLON fabric.

The glove 100 also comprises finger pads 114 for protecting the dorsal surface DS of each finger F. While the glove 100 is shown as having, on each finger, first and second protective pads 114 and one flexion zone between these two pads 114, it will become apparent to a person skilled in the art that a variety of other patterns of protective pads/flexion zones may be used. For example, on each finger, the glove may comprise three finger pads with two flexion zones.

Figure 4A:
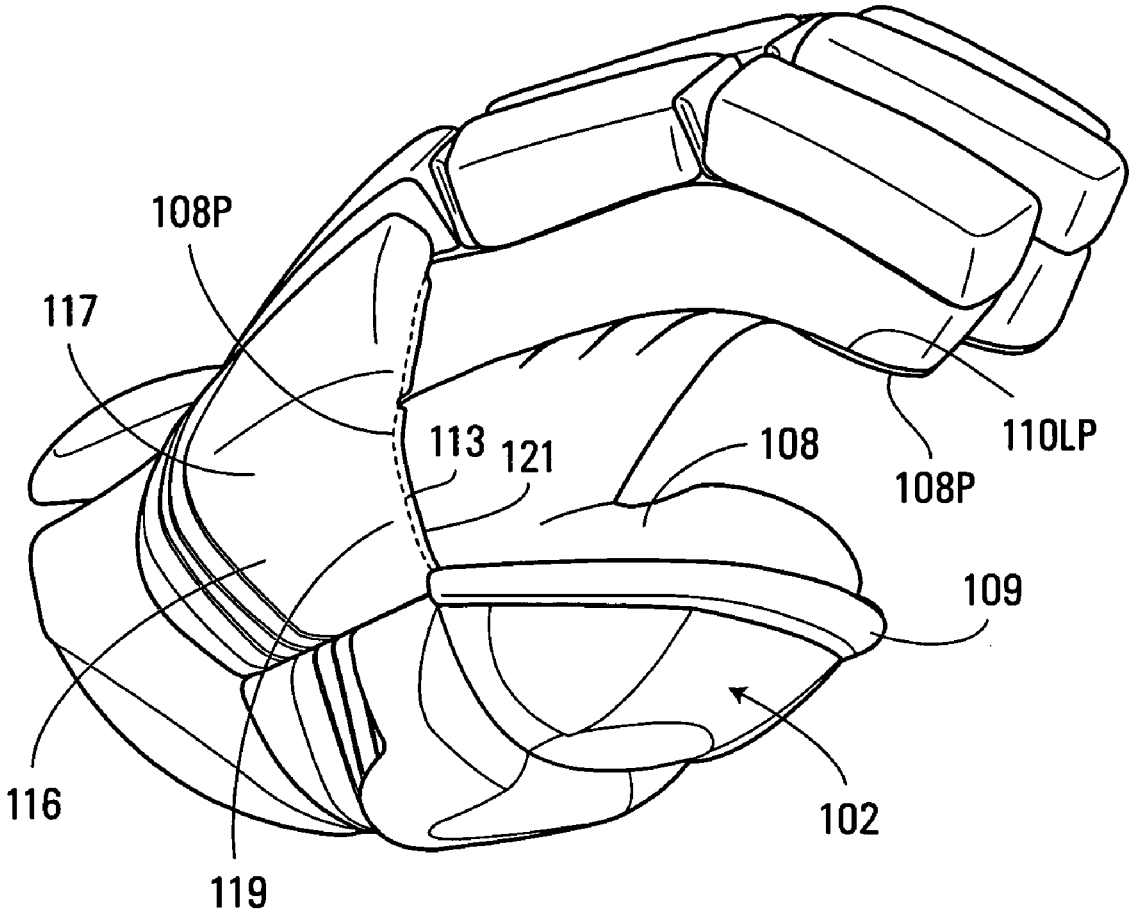
FIG. 4A is a front side perspective view of the hockey glove of FIG. 4, in which the index finger pads and the layer covering the palm sheet have been removed for better illustrating the palm sheet.

As seen in FIGS. 4 and 4A, the glove 100 further comprises a side pad 116 for covering at least partially the medial side MS of the hand. The side pad 116 has a top portion 117 and a side portion 119 with an edge 121 generally following the C-shaped edge CE of the hand.

Reverting to FIGS. 4 and 5, the glove 100 also comprises a layer 118 for covering at least partially the palm sheet 108. The layer 118 is made of a suitable material such as soft leather, leather-like materials, synthetic suede, or Nash fabric. An example of a suitable material is commercialized under the trade-mark CLARINO. The layer 118 may also be treated with silicone to improve stick control.

The glove 100 also comprises a first index finger pad 128 that covers the medial side of the index finger and that is located proximate the proximate phalanx and a second index finger pad 130 that covers the medial side of the index finger and that is located proximate the middle phalanx.

Figure 5A:
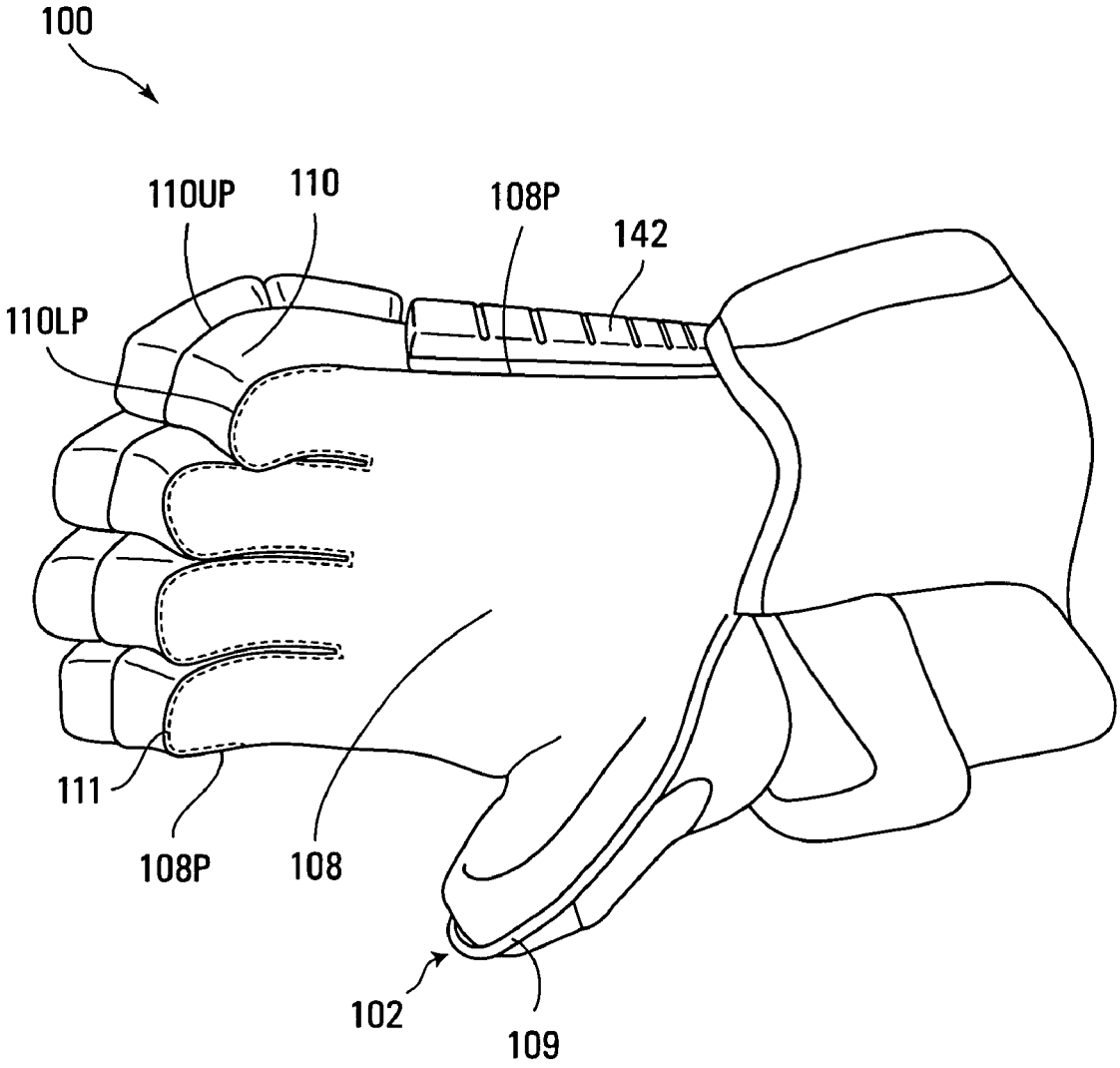
FIG. 5A is bottom perspective view of the hockey glove of FIG. 4A.

Referring to FIGS. 4A and 5A, in which the index finger pads 128, 130 and the layer 118 have been removed, the side finger web 110 has an upper periphery 110UP and a lower periphery 110LP and the palm sheet 108 has a palm periphery 108P with a first palm periphery portion affixed to the periphery of the thumb sheath 102 via a first braiding 109, a second palm periphery portion affixed to the lower periphery 100LP, via stitches 111, for defining the finger gussets 112 (see FIG. 5A), and, between the index finger sheath 106 and the thumb sheath 102, a third palm periphery portion affixed to the edge 121 of the side portion 119 of the side pad 116 via stitches 113 (see FIG. 4A). Hence, instead of being affixed to the glove via a braiding similar to the braiding 22 shown in FIGS. 2 and 3, the third palm periphery portion of the palm periphery 108 is directly affixed to the side pad 116 via stitches 113.

Reverting to FIG. 4, the layer 118 has a first portion 120 extending over the side portion 119 of the side pad 116 such that this portion 120 covers the connection between the palm sheet 108 and side pad 116. In other words, the portion 120 of the layer 118 extends over the third palm periphery portion of the palm periphery 108 and over the side portion 119 of the side pad 116. The portion 120 further extends over the top portion 117 of the side pad 116 and has a periphery 122 affixed to this top portion 117 via stitches 124. The periphery 122 extends along a line that is substantially parallel to a line following the C-shaped edge CE of the hand. The portion 120 may comprise a V-shaped opening 126 at the periphery 122.

The layer 118 has a second portion 132 extending at least partially over the first index finger pad 128. The second index finger pad 130 may also be covered with a layer made of a material similar to the one of the layer 118.

As shown in FIG. 5, the glove 100 further comprises a first little finger pad 134 that covers the lateral side of the little finger and that is located proximate the proximate phalanx and a second little finger pad 136 that covers the lateral side of the little finger and that is located proximate the middle phalanx. The layer 118 has a third portion 138 extending at least partially over the first little finger pad 134. The second little finger pad 136 may also be covered with a layer made of a material similar to the one of the layer 118.

As shown in FIGS. 5 and 5A, the glove 100 comprises a further pad 142 for covering the lateral side LS of the little finger F.

It is understood that the layer 118 may cover an important portion of the palm sheet 108 as best seen in FIG. 5. Moreover, the layer 118 may cover an important portion of the portion of the palm portion 108 that faces the palm surface PS of the thumb T. The glove 100 may also comprise further rounded layers 140 each covering a portion of the palm sheet 108 at the end of each finger F.

Reverting to FIG. 5A, the palm periphery 108P is not directly affixed to the glove along the pad 142 since, as shown in FIG. 5, this portion of the palm periphery 108P is rather affixed to the glove via a braiding 144 made of a portion of the layer 118.

The above description of embodiments should not be interpreted in a limiting manner since other variations, modifications and refinements are possible within the spirit and scope of the present invention. The scope of the invention is defined by the appended claims and their equivalents.

The invention claimed is:

1. A hockey glove for receiving a hand of a player, the hand having a palm, index finger, middle finger, third finger and little finger, each finger having palm, dorsal, lateral and medial surfaces, proximate, middle and distal phalanges, one thumb with palm and dorsal surfaces, and a medial side with a C-shaped edge between the thumb and the index finger, said hockey glove comprising:

(a) a side finger web for facing the lateral and medial surfaces of each finger, said side finger web having a lower web periphery;

(b) a palm sheet for facing the palm of the hand and the palm surface of the fingers and thumb, said palm sheet having a palm periphery with a portion connected to said lower web periphery for defining first, second, third and fourth finger gussets for respectively receiving the four fingers;

(c) a side pad for covering at least partially the medial side of the hand, said side pad having a top portion and a side portion with an edge for overlapping the C-shaped edge of the medial side of the hand; and (d) a layer covering at least partially said palm sheet, said layer comprising a portion extending over said side portion of said side pad and said top portion of said side pad, said portion of said layer having a periphery affixed to said top portion of said side pad, said periphery extending along a line that is substantially parallel to a line following the C-shaped edge of the medial side of the hand.

2. A hockey glove as defined in claim 1, wherein said portion of said layer comprises a V-shaped opening at said periphery.

3. A hockey glove as defined in claim 1, further comprising a thumb sheath for enclosing the thumb, said thumb sheath having a thumb sheath periphery; wherein said portion of said palm periphery connected to said lower web periphery is a first palm periphery portion, said palm periphery comprising a second palm periphery portion connected to said thumb sheath periphery via a braiding and a third palm periphery portion connected to said edge of said side portion of said side pad; and wherein said portion of said layer covers said third palm periphery portion, further extends over said top portion of said side pad, and has a periphery affixed to said top portion of said side pad.

4. A hockey glove as defined in claim 3, further comprising an index finger pad for covering the medial side of the index finger; wherein said portion extending at least partially over said side pad is a first portion; and wherein said layer comprises a second portion extending at least partially over said index finger pad.

5. A hockey glove as defined in claim 4, further comprising a little finger pad for covering the lateral side of the little finger and wherein said layer comprises a third portion extending at least partially over said little finger pad.

6. A hockey glove as defined in claim 5, said index finger pad is a first index finger pad that covers the medial side of the index finger and that is located proximate the proximate phalanx, said glove further comprising a second index finger pad that covers the medial side of the index finger and that is located proximate the middle phalanx.

7. A hockey glove as defined in claim 6, said little finger pad is a first little finger pad that covers the lateral side of the little finger and that is located proximate the proximate phalanx, said glove further comprising a second little finger pad that covers the lateral side of the little finger and that is located proximate the middle phalanx.

8. A hockey glove as defined in claim 7, further comprising a layer covering said second index finger pad.

9. A hockey glove as defined in claim 8, further comprising a layer covering said second little finger pad.

10. A hockey glove as defined in claim 3, further comprising rounded layers each covering a portion of said palm sheet at the end of each finger.

11. A hockey glove as defined in claim 3, wherein said layer covers a substantial portion of said palm sheet.

12. A hockey glove as defined in claim 3, wherein said layer covers a substantial portion of a portion of said palm sheet that faces the palm surface of the thumb.

13. A hockey glove as defined in claim 3, wherein said layer is made of leather or synthetic suede.

14. A hockey glove for receiving a hand of a player, the hand having a palm, index finger, middle finger, third finger and little finger, each finger having palm, dorsal, lateral and medial surfaces, proximate, middle and distal phalanges, one thumb with palm and dorsal surfaces, and a medial side region between the thumb and the index finger, said hockey glove comprising:

(a) a side finger web for facing the lateral and medial surfaces of each finger, said side finger web having a lower web periphery;

(b) a thumb sheath for enclosing the thumb, said thumb sheath having a thumb sheath periphery;

(c) a palm sheet for facing the palm of the hand and the palm surface of the fingers and thumb, said palm sheet having a palm periphery, with a first palm periphery portion connected to said thumb sheath periphery via a braiding projecting outwardly from said thumb sheath and a second palm periphery portion connected to said lower web periphery for defining first, second, third and fourth finger gussets for respectively receiving the four fingers;

(d) first, second, third and fourth finger pads mounted on said respective first, second, third and fourth finger gussets for protecting the dorsal surface of the respective four fingers;

(e) a side pad for covering at least partially the medial side region of the hand, said side pad having a top portion and a side portion with an edge for overlapping the medial side region of the hand; and (f) a layer for covering at least partially said palm sheet, said layer comprising a portion extending over said side portion of said side pad such that said edge of said side portion of said side pad is free of said braiding.

15. A hockey glove as defined in claim 14, wherein said portion of said layer further extends over said top portion of said side pad.

16. A hockey glove as defined in claim 15, wherein said portion of said layer has a periphery affixed to said top portion of said side pad.

17. A hockey glove as defined in claim 16, wherein said periphery of said layer extends along a line that is substantially parallel to a line following the medial side of the hand.

18. A hockey glove as defined in claim 17, wherein said portion of said layer comprises a V-shaped opening at said periphery.

19. A hockey glove as defined in claim 14 further comprising an index finger pad for covering the medial side of the index finger, wherein said portion of said layer is a first portion, and wherein said layer comprises a second portion extending at least partially over said index finger pad.

20. A hockey glove as defined in claim 19, further comprising a little finger pad for covering the lateral side of the little finger and wherein said layer comprises a third portion extending at least partially over said little finger pad.

21. A hockey glove as defined in claim 20, said index finger pad is a first index finger pad that covers the medial side of the index finger and that is located proximate the proximate phalanx, said glove further comprising a second index finger pad that covers the medial side of the index finger and that is located proximate the middle phalanx.

22. A hockey glove as defined in claim 21, said little finger pad is a first little finger pad that covers the lateral side of the little finger and that is located proximate the proximate phalanx, said glove further comprising a second little finger pad that covers the lateral side of the little finger and that is located proximate the middle phalanx.

23. A hockey glove as defined in claim 14, further comprising rounded layers each covering a portion of said palm sheet at the end of each finger.

24. A hockey glove as defined in claim 14, wherein said layer covers a substantial portion of said palm sheet.

25. A hockey glove for receiving a hand of a player, the hand having a palm; an index finger, a middle finger, a third finger and a little finger, each finger having palm, dorsal, lateral and medial surfaces and proximate, middle and distal phalanges; a thumb having palm and dorsal surfaces; and a medial side region between the thumb and the index finger; said hockey glove comprising:

(a) a side finger web for facing the lateral and medial surfaces of each finger, said side finger web having an upper web periphery and a lower web periphery;

(b) a thumb sheath for enclosing the thumb;

(c) a palm sheet for facing the palm of the hand and the palm surface of the fingers and thumb;

(d) an index finger sheath, a middle finger sheath, a third finger sheath and a little finger sheath, wherein each finger sheath has a protective pad connected to said upper web periphery and wherein said palm sheet is connected to said lower web periphery for respectively enclosing the index finger, middle finger, third finger and little finger;

(e) a side pad for protecting the medial side region of the hand, said side pad having a top portion and a side portion; and (f) a layer for covering at least partially said palm sheet, said layer having a portion extending over said side pad and being connected to said side pad such that an edge of said hockey glove located between said index finger sheath and said thumb sheath is free of any braiding projecting outwardly.

26. A hockey glove as defined in claim 25, wherein said portion of said layer further extends over said top portion of said side pad.

27. A hockey glove as defined in claim 26, wherein said portion of said layer has a periphery affixed to said top portion of said side pad.

28. A hockey glove as defined in claim 27, wherein said periphery of said layer extends along a line that is substantially parallel to a line following the medial side of the hand.

29. A hockey glove as defined in claim 25, where said index finger sheath has an index finger pad for covering the medial side of the index finger, wherein said portion of said layer is a first portion, and wherein said layer comprises a second portion extending at least partially over said index finger pad.

* * * * *

UNITED STATES PATENT AND TRADEMARK OFFICE

CERTIFICATE OF CORRECTION

PATENT NO. : 7,562,398 B2
APPLICATION NO. : 11/494488
DATED : July 21, 2009
INVENTOR(S) : Beland et al.

It is certified that error appears in the above-identified patent and that said Letters Patent is hereby corrected as shown below:

Title page item [73] the assignee's name should be corrected to read: BAUER HOCKEY, INC.

Signed and Sealed this

Seventeenth Day of August, 2010

David J. Kappos

David J. Kappos
*Director of the United States Patent and Trademark Office*